United States Patent [19]

Lochte et al.

[11] 4,193,449

[45] Mar. 18, 1980

[54] VALVE OPERATING CIRCUIT

[75] Inventors: Glen E. Lochte, Houston; Lionel J. Milberger, Spring, both of Tex.

[73] Assignee: FMC Corporation, San Jose, Calif.

[21] Appl. No.: 912,275

[22] Filed: Jun. 5, 1978

[30] Foreign Application Priority Data

Aug. 12, 1977 [GB] United Kingdom ..... 33848/77

[51] Int. Cl.[2] ..... E21B 33/03; E21B 43/00

[52] U.S. Cl. ..... 166/72; 166/321

[58] Field of Search ..... 166/72, 321, 322; 137/485, 625.6

[56] References Cited

U.S. PATENT DOCUMENTS

| | | | |
|---|---|---|---|
| 2,998,070 | 8/1961 | Tamplen et al. | 166/72 |
| 3,078,923 | 2/1963 | Tausch | 166/72 |
| 3,375,874 | 4/1968 | Cherry et al. | 166/321 |
| 4,082,147 | 4/1978 | Wolff et al. | 166/323 |

*Primary Examiner*—James A. Leppink

*Attorney, Agent, or Firm*—W. William Ritt, Jr.; Lloyd B. Guernsey; J. F. Verhoeven

[57] ABSTRACT

A hydraulic valve operating circuit for providing positive opening and closing of a downhole safety valve includes shut-off valves which prevent leakage of fuel to the outside environment if a leak should occur in the hydraulic lines which are connected to the hydraulic actuator of the downhole safety valve. A hydraulic control line is connected to the actuator of the safety valve through a normally-closed shut-off valve and the hydraulic control line is also connected to the actuator of the shut-off valve to hold both the shut-off valve and the downhole safety valve open when the hydraulic line is pressurized. Another valve moves to a position to direct the flow of fluid from the safety valve to an accumulator when the pressure in the control line falls below a predetermined value to insure that the downhole safety valve will close properly.

13 Claims, 4 Drawing Figures

FIG_2
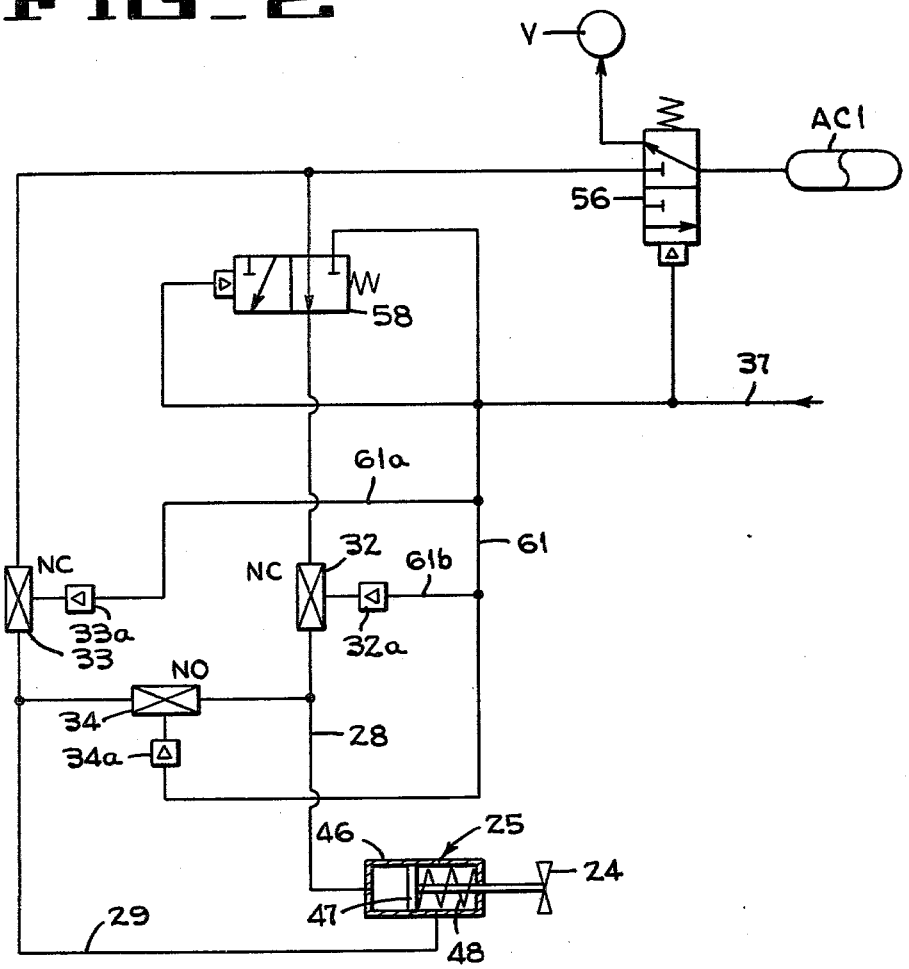
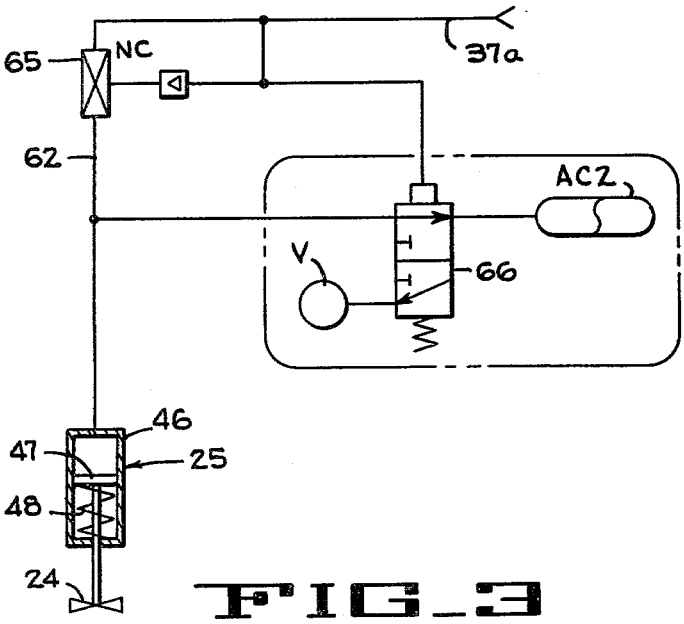
FIG_3
FIG_4
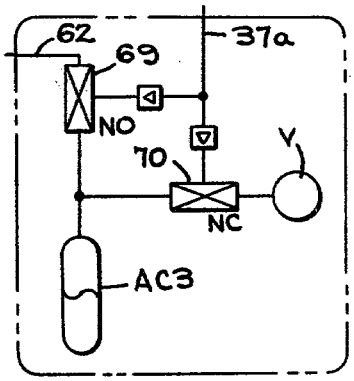

VALVE OPERATING CIRCUIT

BACKGROUND OF THE INVENTION

1. Field of the Invention

This invention relates to hydraulic valve control circuits and more particularly to valve operating circuits for providing positive opening and closing of downhole safety valves while preventing leakage of fuel to the outside environment.

2. Description of the Prior Art

Crude oil and gas wells are often drilled and tubing is installed at locations where the internal pressure of the petroleum deposit is quite high so that precautions must be taken to prevent a blowout of the well. Such blowouts are not only costly in terms of loss of oil or gas but in addition a blowout is highly dangerous and the cost of controlling a blowout at an oil or gas well is rather high. As a result, many devices including safety valves and associated control circuits have been developed and many such devices have been installed in association with gas and oil wells. One such device which is frequently employed is a surface-controlled, sub-surface, safety valve (SCSSV) otherwise known as a downhole safety valve (DHSV) which may be installed within the tubing of a well either at the time the tubing is installed or alternatively such a valve can be installed from the surface using well-known wire line techniques. Such valves are generally installed 200 or 300 feet below the wellhead and are always of the "fail-clse" design. The construction of these valves resembles a conventional ball valve and positive actuation against a spring is required to open a valve, for example by applying hydraulic pressure to a small diameter control line and to a valve actuator which can be conveniently located within the well. In some of the installations the valve actuator can be positioned outside the tubing.

The controlling hydraulic pressure applied to the control line must be sufficient to develop a force on one face of the piston of the actuator which is greater than the combination of the opposing force developed by gas or oil pressure in the tubing acting on the opposite face of the piston and by the spring-generated valve closing force. Because of the depth of the safety valves there is a substantial fluid head in the control line which provides a substantial amount of tubing pressure acting on the piston of the actuator, so that the spring force and the valve depth and the location of the safety valve must be carefully selected to ensure complete closure of the valve when the pressure in the control line is relieved by action taken at the surface.

Another type of SCSSV hydraulic circuit in common use involves a hydraulic balance and requires both a hydraulic control line to open and close the valve and a balance line which communicates with the opposing face of the piston of the actuator. By means of this arrangement, the control line pressure needs only to overcome the spring force since otherwise the forces are equal but opposite as developed by the head in both the control line and in the balance line.

Whether a balanced type SCSSV or a non-balanced type is used, it is common practice to pass the control and/or balance lines through the wellhead and its connector and then exit the christmas tree below the master valve. The control and/or balance lines, after leaving the christmas tree, are connected to a control system to enable operation of the SCSSV.

The previously proposed control systems have the disadvantage that if a malfunction such as a leak occurs in the DHSV, which results in connecting the tubing bore to the control line, a high pressure leakage path is then formed to the outside environment. Such a leak can damage the control system and also allow oil or gas to pollute the environment. This problem has already been appreciated and with a view to solving it, shut-off valves have been provided where the control and/or balance lines leave the christmas tree. By this provision, if a leak should occur, the shut-off valves can be closed manually but further problems arise if the christmas tree is installed below the surface of the sea because the shut-off valves will then require actuators, for example, hydraulic actuators so that the shut-off valves can be remotely opened or closed.

It will be apparent that the shut-off valves in the control and/or balance lines must be open when it is desired to open the associated DHSV or SCSSV so that fluid can be forced under pressure to the actuating cylinder of the DHSV or SCSSV. Even more important, the shut-off valves must remain open until the DHSV or SCSSV has completely closed. Once the latter has closed it is desirable to close fully the shut-off valve. However, if the shut-off valves are allowed to close before the DHSV or SCSSV has completely closed, the shut-off valves will not allow fluid to flow away from the actuator of the DHSV or SCSSV, and therefore the latter will remain open or partially open. It follows that for fully safe operation there must be proper co-operation between the actuator of the DHSV or SCSSV and the shut-off valves particularly for remote or sub-sea surface locations. In order more fully to take into account the difficulties outlined above, control systems such as hydraulic sequencing or electro-hydraulic multiplexing systems have been proposed so that the shut-off valves are connected to a separate hydraulic output lines of the control system and are actuated independently of the DHSV or SCSSV control line. These proposed control systems are generally satisfactory but do not provide for the sudden loss of hydraulic pressure in the control system. Such loss in hydraulic pressure will result in the well becoming shut down because all the valves from the christmas tree including the DHSV or SCSSV will close because of their "fail-close" characteristics. However, the loss of hydraulic pressure will provide no assurance that the shut-off valves will remain open long enough to allow complete closure of the associated DHSV or SCSSV.

As an alternative to the complexities of hydraulic sequencing or electro-hydraulic multiplexing, a simple hydraulic time delay circuit has been proposed which comprises simply a restrictor valve and an accumulator which ensures that the DHSV or SCSSV closes before the shut-off valve is timed to close. This system has the merit of simplicity but does not provide a complete answer to the problems involved. In particular it is neither possible readily to know the exact closing time of the DHSV after installation not is it possible to ensure that it will remain constant over long periods of time. To ensure that the system is basically safe, it has been proposed simply to make the time constant long enough to accommodate the longest possible closing times for the DHSV or SCSSV. However, such long time constants require either very small orifice restrictor valves which are liable to clog or large accumulators which cannot readily be accommodated in the limited space available.

SUMMARY OF THE INVENTION

The present invention for providing positive opening and closing of a downhole safety valve includes a plurality of shut-off valves mounted in the walls of the well to connect the safety valve actuator to an outside hydraulic pressure source and to a pressure sink while isolating the safety valve from the outside environment. The shut-off valves prevent leakage of the petroleum to the outside environment if a leak should occur between the inside of the well and the hydraulic lines which are connected to the safety valve actuator. The shut-off valves also insure that the safety valve will close properly by relieving the fluid pressure applied to the safety valve actuator when it is desired to close the safety valve.

A hydraulic circuit according to the present invention comprises a fail-close safety valve, shut-off valve means in control piping of the safety valve operative to close on a drop in pressure in the control piping below a predetermined value, a safety valve actuator connected to the control piping and means operative on drop of pressure in the control piping to relieve pressure in the safety valve actuator whereby the safety valve and the shut-off valve means can close.

Further according to the present invention there is provided a control circuit for a fail-close surface-controlled, sub-surface, safety valve or a fail-close downhole safety valve comprising an actuator for the safety valve, a shut-off valve in a circuit connected to the safety valve and means responsive to a drop in pressure in the control circuit below a predetermined value to relieve pressure in the actuator of the safety valve and thus allow the safety valve and the shut-off valve to close.

Still further according to the present invention there is provided a hydraulic circuit comprising a downhole, fail-close safety valve, an actuator positively operable to open the safety valve, a control line of the circuit communicating through one normally-closed, shut-off valve with one face of the actuator piston, a balance line of the circuit communicating with the other face of the actuator piston through a second normally-closed shut-off valve, a control function line of the circuit communicating with actuators of the shut-off valves to hold the valves open when pressurized and a normally open shut-off valve providing communication between the two faces of the safety valve actuator whereby on reduction of pressure in the control function line the latter shut-off valve opens, the normally-closed shut-off valves close and the safety valve is free to close by virtue of its fail-close characteristic.

Yet further according to the present invention there is provided a hydraulic circuit comprising a downhole, fail-close, safety valve for incorporation in an oil or gas well, an actuator positively operable to open the safety valve, a control line of the circuit communicating with the actuator of the safety valve through a normally-closed shut-off valve, a control function line of the circuit connected to an actuator of the shut-off valve to hold the latter and the safety valve open when pressurized, an accumulator, and a valve movable to a position in which flow can take place from the safety valve actuator to the accumulator when pressure in the control function line falls below a predetermined value whereby the fail-close characteristics of the safety valve can be asserted.

BRIEF DESCRIPTION OF THE DRAWINGS

FIG. 2 is a circuit diagram of one embodiment of the present invention.

FIGS. 3 and 4 illustrate other embodiments of the present invention.

DESCRIPTION OF THE PREFERRED EMBODIMENT

Figure 1:
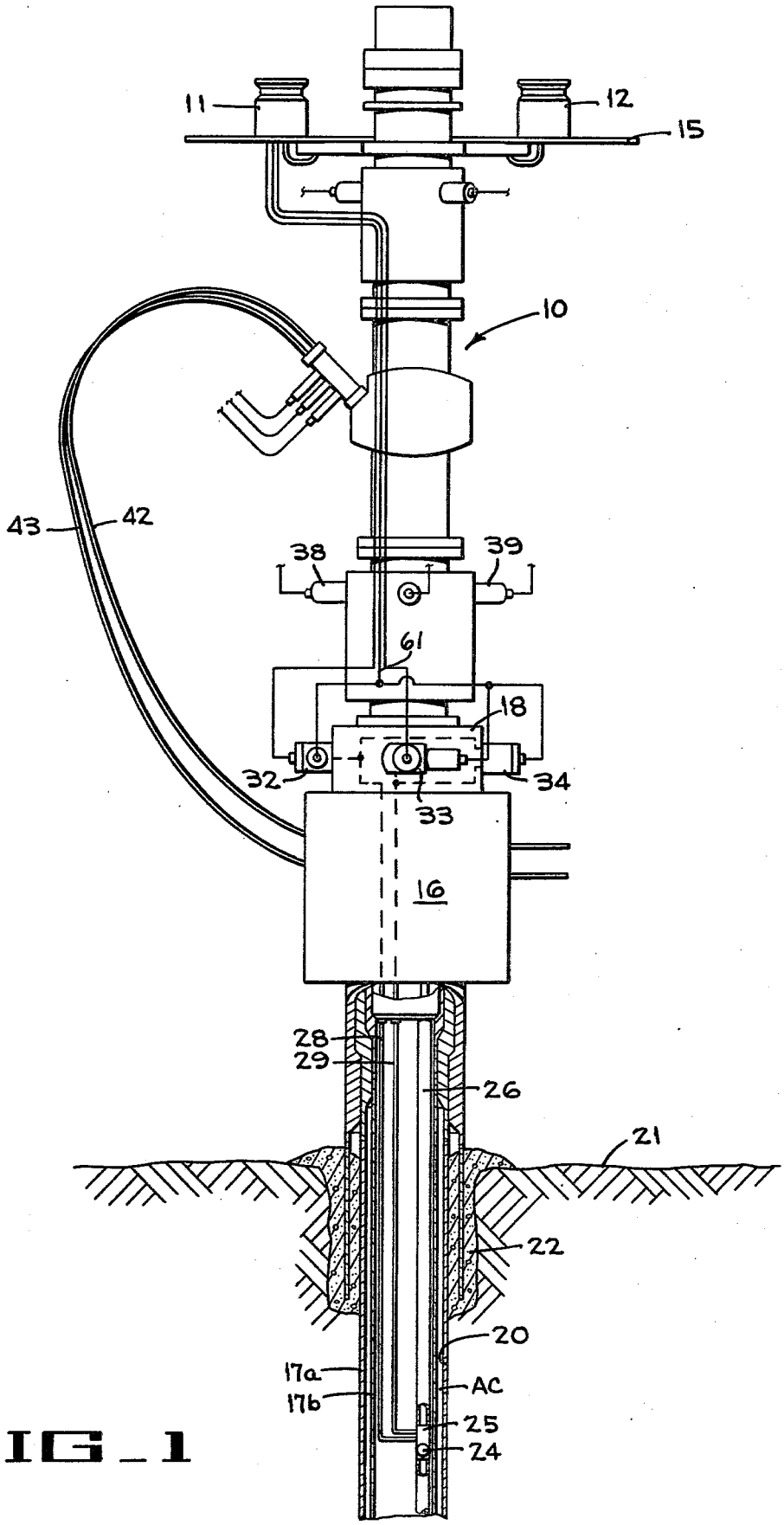
FIG. 1 is a diagrammatic side elevation of a subsea well in which the present invention may be used, with portions being broken away.

Referring now to the drawings, FIG. 1 discloses a petroleum well of the type that is used to produce oil and gas and includes a christmas tree 10 and a pair of control modules 11,12 mounted on a mounting plate 15. The christmas tree 10 is mounted atop the well by a tree connector 16, and a plurality of casing strings **17*a*,17*b* are suspended into a bore hole 20 drilled into a portion of the sea floor 21. The casing strings 17*a*,17*b* are anchored in position by cement 22 which is pumped into the annulus between the bore hole 20** and the outermost string of casing.

A downhole safety valve 24 and a downhole safety valve actuator 25 are mounted inside the inner string **17*b* several feet below the christmas tree 10 to provide positive control of fluid through a tubing string 26. The downhole safety valve actuator 25 is coupled to a hydraulic fluid pressure source and to a sink (not shown) in FIG. 1 by a pair of hydraulic lines 28,29 and by a plurality of shut-off valves or block valves 32–34 mounted in the wall of the christmas tree 10. The block valves 32–34 can be connected to a remote source of hydraulic fluid under pressure by a hydraulic line 37. A pair of valve operators 38,39 (FIG. 1) control the operation of a pair of christmas tree valves (not shown) inside the christmas tree to control the flow of oil from the christmas tree through a pair of flow lines 42,43 which are connected to the christmas tree. The flow lines are each in the form of a loop having sufficient radius so that conventional "through-flow-loop" tools (not shown) can pass through the flow lines. Operation of the valve operators 38,39 is controlled by the control modules 11,12**.

A circuit which provides control of a balance type downhole safety valve 24 (FIG. 2) includes the safety valve actuator 25 having an annular body 46 with a piston 47 mounted therein. The piston 47 is biased toward the left end of the actuator by a spring 48 which closes the valve when the piston is adjacent the left end of the body 46. The hydraulic control line 28 provides hydraulic fluid under pressure to move the piston 47 toward the right thereby opening the downhole safety valve 24, while the balance line 29 provides a fluid inlet to the right end of the annular body 46.

One face of the piston 47 of the actuator 25 is subjected to the pressure of the control line 28 (FIG. 2) through a normally-closed, shut-off valve 32 and the other face of the piston 47 is subjected to the pressure in the balance line 29 through the normally-closed, shut-off valve 33. The balance line 29 can be connected to an accumulator AC1 through a valve 56 when the latter is subjected to pressure in the control function line 37. Under this condition, a valve 58 provides communication between the control line 28 and a line 61 which is also permanently connected to the control function line 37. Under non-pressurized conditions the valves 56 and 58 assume the positions shown, with the accumulator AC1 dumping liquid to the sink V and valve 58 providing a communication between the balance and the control lines 29,28. The accumulator AC1 may be an enclosed tank which is connected to the valve 56 or an annular chamber AC between the casing strings 17a,17b (FIG. 1) may be used to store the hydraulic fluid. The system is preferably vented to sea with liquid from the sink V being discharged directly into the sea. In a vent-to-sea hydraulic system the hydraulic fluid contains a large percentage of water, for example, it may be 95% water. This results in a hydraulic fluid having a specific gravity of approximately 1 so that a pressure balance is achieved at the outlet of the subsea valve.

The shut-off valves 32 and 33 are normally closed and the shut-off valve 34 is normally open thereby connecting the control line 28 and the balance line 29 at a location in the circuit between the shut-off valves 32 and 33 and allowing the piston 47 of the actuator 25 to move toward the left as shown in FIG. 2. The actuator 34a of the valve 34 is connected to the control function line 37 by the line 61 which has branches 61a,61b connected to the actuators 33a,32a of the shut-off valves 33 and 32. It will be apparent that when the single control function line 37 is unpressurized, the valves 32 and 33 will be closed, the valve 34 will be open and under this condition the DHSV 24 should also move to its closed position. The low pressure on line 61 allows the valve 34 to open thereby providing a circulation path for the fluid in the DHSV actuator 25 so that fluid can be displaced from one face of the actuator piston 47 to the other and thus DHSV 24 is free to move to its closed position under the action of the spring 48.

The valves 32, 33 and 34 are physically located in a christmas tree adaptor 18 (FIG. 1) positioned above the wellhead connector 16 and below the valve operators 38 and 39. The porting and connection between the valves 32,33 and 34 may be provided by cross-drilling in the tree adaptor 18 or tubing may be mounted outside the adaptor and connected between the various block valves.

Another embodiment of the present invention as shown in FIG. 3 incorporates a DHSV which is of the non-balancing type and is operated by a single control line 62. A single SCSSV control function line 37a is connected to the control line 62 of the DHSV through a shut-off valve 65 which is normally closed. The control function line 37a is also connected to a valve 66 which, in the non-pressurized condition illustrated in FIG. 3 provides a direct connection from the control line 62 to an accumulator AC2. When the single control function line 37a is unpressurized, the valve 65 is closed and the valve 66 is in its normal, unenergized position as shown in FIG. 3. If the valve 65 were to close prior to the complete closing of the DHSV 25, the remaining fluid in the space above the piston 47 of the actuator 25 will be displaced into the accumulator AC2 through valve 66 thereby allowing the actuator to close the safety valve 24. Upon repressurization of the single control function line 37a the valve 66 shifts to block the control line 62 and dumps the fluid from the accumulator AC2 to the sink V.

The valve 66 is a commonly used 3-way valve which can be replaced by a pair of 2-way valves as shown in the embodiment of FIG. 4. In this embodiment the valve 66 is replaced by a normally-opened valve 69 and a normally-closed valve 70. When the single function control line 37a is unpressurized the valve 69 is in its normal open position so that the accumulator AC3 is connected to line 62 and the remaining fluid from the actuator 25 is stored in the accumulator AC3. Upon repressurizing of the single control function line 37a the valve 69 is closed and valve 70 is open s that the fluid stored in the accumulator AC3 will be dumped through the valve 70 to the sink V. Advantage of the circuit of FIG. 4 is that the same set of block valves which were shown in FIGS. 1 and 2 can be used to perform in the circuit shown in FIG. 4. One valve which can be used for each of the valves 32–34 and for valves 65,69 and 70 is a one inch slide gate valve with a hydraulic actuator, Model 40, manufactured by the FMC Corporation, Houston, Tex.

It is believed that the hereinbefore described hydraulic circuits will insure proper cooperation of the DHSV or the SCSSV and the shut-off valves whether operating in an oil or a gas well. Some of the advantages of the circuit shown in the present invention are as follows: (1) Only one control function line is needed to operate the DHSV and the shut-off valves; (2) The circuit can be adapted to both balanced and nonbalanced DHSVs; (3) The circuit is very simple and no substantial further complication is involved beyond the provision of the well known shut-off valves; (4) A small number of additional components is required; and (5) The DHSV remains free to displace hydraulic fluid so that it can close properly while the hydraulic passage through the wellhead is blocked off by a metal seal gate valve.

Although the best mode contemplated for carrying out the present invention has been herein shown and described, it will be apparent that modification and variation may be made without departing from what is regarded to be the subject matter of the invention.

We claim:

1. A hydraulic valve operating circuit for opening and closing a downhole safety valve, said circuit connected for use with a source of pressurized hydraulic fluid and a downhole safety valve mounted in a petroleum well having a wall, said safety valve including a valve actuator having an inlet port, said well including block valves mounted to a christmas tree atop said well to connect the safety valve actuator to an outside hydraulic presssure source and to a pressure sink while isolating the safety valve from the outside environment, said circuit comprising:

a normally closed block valve connected between said source of hydraulic fluid and said inlet port of said safety valve actuator;

means for mounting said block valve in the wall of the well between the inside of said well and the outside of said well;

means for opening said block valve in response to an increase in pressure from said source of fluid; and valve means for relieving the fluid pressure at said inlet port of said actuator when said block valve is closed, said valve means being coupled to said inlet port of said safety valve actuator.

2. A hydraulic valve operating circuit as defined in claim 1 wherein said means for relieving the fluid pressure includes; an accumulator; means for connecting said accumulator to said inlet port of said safety valve actuator in response to a predetermined change in fluid pressure from said source of hydraulic fluid.

3. A hydraulic safety valve operating circuit as defined in claim 2 including means for connecting said normally closed valve between said source of fluid and said inlet port of said safety valve in response to 4. A hydraulic safety valve operating circuit as defined in claim 1 wherein said sink includes an accumulator for storage of hydraulic fluid, a second normally closed block valve, means for coupling said accumulator to said second normally closed valve in response to an increase in pressure from said source of fluid and means for dumping the contents of said accumulator in response to a decrease in pressure from said source of fluid.

5. A hydraulic safety valve operating circuit for opening and closing a downhole safety valve, said circuit connected for use with a source of pressurized hydraulic fluid, an accumulator and a downhole safety valve mounted in a petroleum well, said safety valve having an inlet port, said circuit comprising:

a normally closed valve connected between said source of hydraulic fluid and said inlet port of said downhole safety valve;

means for mounting said normally closed valve between the inside of said well and the outside of said well;

means for opening said normally closed valve in response to an increase in pressure from said source of fluid;

means for coupling said inlet port of said downhole safety valve to said accumulator when said normally closed valve is deactivated; and means for dumping the contents of said accumulator in response to an increase in pressure from said source of fluid.

6. A hydraulic safety valve operating circuit as defined in claim 5 including a two position valve, said two-position valve having means for connecting said inlet port of said downhole safety valve to said accumulator when said two-position valve is deenergized and having means for connecting said accumulator to a sink when said two-position valve is energized.

7. A hydraulic safety valve operating circuit for opening and closing a downhole safety valve, said circuit connected for use with a source of pressurized hydraulic fluid, a sink and a downhole safety valve mounted in a petroleum well, said safety valve having an inlet port and an outlet port, said circuit comprising:

a normally open valve connected between said inlet and said outlet ports of said safety valve;

first and second normally closed valves;

means for selectively connecting said first normally closed valve between said source of hydraulic fluid and said inlet port of said downhole safety valve;

means for selectively connecting said second normally closed valve between said outlet port of said downhole safety valve and said sink; and means for actuating said first and said second normally closed valves and said normally open valve in response to an increase in pressure from said source of fluid.

8. A hydraulic safety valve operating circuit as defined in claim 7 including means for simultaneously closing said normally open valve and opening said first and said second normally closed valves to couple hydraulic fluid to actuate said downhole safety valve.

9. A hydraulic safety valve operating circuit as defined in claim 7 including a two-position valve, and an accumulator, said two-position valve having means for connecting said accumulator to a sink when said two-position valve is deenergized, and having means for connecting said second normally closed valve to said accumulator when said two-position valve is energized.

10. A hydraulic safety valve operating circuit as defined in claim 7 including means for mounting said normally open valve between the inside of said well and the outside of said well.

11. A hydraulic safety valve operating circuit for opening and closing a downhole safety valve, said circuit connected for use with a source of pressurized hydraulic fluid, a sink and a downhole safety valve mounted in a petroleum well having a wall, said safety valve having an inlet port and an outlet port, said circuit comprising:

a normally open valve connected between said inlet and said outlet ports of said safety valve;

first and second normally closed valves;

means for mounting said normally open and said normally closed valves in the wall of the well between the inside of said well and the outside of said well;

means for selectively connecting said first normally closed valve between said source of hydraulic fluid and said inlet port of said downhole safety valve;

means for selectively connecting said second normally closed valve between said outlet port of said downhole safety valve and said sink; and means for actuating said first and said second normally closed valves and said normally open valve in response to an increase in pressure from said source of fluid.

12. A hydraulic safety valve operating circuit as defined in claim 11 including means for simultaneously closing said normally open valve and opening said first and said second normally closed valves to couple hydraulic fluid to actuate said downhole safety valve.

13. A hydraulic safety valve operating circuit as defined in claim 11, including a two-position valve, and an accumulator, said two-position valve having means for connecting said accumulator to a sink when said two-position valve is deenergized, and having means for connecting said second normally closed valve to said accumulator when said two-position valve is energized.

* * * * *